US005678250A

United States Patent [19]

Nolan

[11] Patent Number: 5,678,250

[45] Date of Patent: Oct. 21, 1997

[54] MALE PANTS POUCH

[76] Inventor: Donal J. Nolan, P.O. Box 6550, Denver, Colo. 80206

[21] Appl. No.: 717,709

[22] Filed: Sep. 23, 1996

[51] Int. Cl.[6] ..... A41D 1/06

[52] U.S. Cl. ..... 2/227; 2/228

[58] Field of Search ..... 2/227, 228, 234, 2/79, 69, 80, 403, 78.1–78.4; 602/67–72

[56] References Cited

U.S. PATENT DOCUMENTS

| | | | |
|---|---|---|---|
| 2,285,692 | 6/1942 | Wickman | 2/227 |
| 2,306,514 | 12/1942 | Wilker et al. | 2/227 |
| 2,702,545 | 2/1955 | Orr | 2/227 |
| 4,215,685 | 8/1980 | Ibel | 2/227 |

*Primary Examiner*—Gloria Hale
*Attorney, Agent, or Firm*—Edwin H. Crabtree; Ramon L. Pizarro; Donald W. Margolis

[57] ABSTRACT

A three-dimensional one-piece male pants pouch for men's pant for providing added comfort and better health for men. The pants pouch design may be used during normal day-to-day routines and during dynamic exercise programs and sports activities. The pouch is designed for use with a variety of different types of pants and eliminates tightness against the male genitals, removes the need for either right or left dress in fitted pants and prevents a tethering of the genitals by a crotch seam in the pants. The one-piece male pants pouch includes a fabric insert sewn into the front of the pants. The pouch fabric can match the fabric of the pants. The fabric insert includes a front and back, a top portion disposed along the belt line of the pants, a first side portion with access for opening and closing the front of the pants, a second side portion and a circular bottom portion. The width of the insert between the first and second side portions is sufficient to cover the male genital area of the wearer of the pants. The bottom portion of the insert is characterized by having darting therein. The darting provides the three-dimensional effect of the pouch for comfortably housing different size male genitals. The bottom portion engages an end of the pants two leg seams and a back seam for absorbing wear stress in the crotch of the pants which heretofore had a seam intersection which is now eliminated.

14 Claims, 1 Drawing Sheet

MALE PANTS POUCH

BACKGROUND OF THE INVENTION

1. Field of Invention

The subject invention relates to pants design and more particularly but not by way of limitation to a unique 3-dimensional one-piece male pants pouch for use in a variety of different types and styles of men's pants.

2. Discussion of the Prior Art

Heretofore prior art construction of men's pants used medial crotch seams, flat triangular pieces and various simple flat gussets. The medial crotch seam, while easiest to produce commercially, has totally ignored the male genitalia and its requirements. The male body is bifurcated through the whole of the crotch seam that essentially abuses the male genitals as if a tethered line were tied between the legs. One approach with this seam has been to wear baggy pants and possibly giving more material to one leg or the other to "right-dress" or "left-dress" the male genitals. This approach still ignored the dynamics of motion that provided constant abrasion and trauma. As styles "tightened up" the design of pants for men hardly changed. The idea of using "leg space" in the pants leg became impossible. The genitals were stuffed into a hazardous zone where space was at a premium and therefore trauma increased. Comfort and health were sacrificed as tight, hot undergarments were employed to remedy this situation.

Various designs using triangular inserts or other simple gussets have been used to try to give back some space. All of these attempts have been less than superior because only a two-dimensional approach in the design has been made. Such an approach simply presses back the male genitalia uncomfortably against the body. Several attempts have been made to use triangular flat forms to help, but these forms rapidly diminish the necessary space in the testicular area as the two sides of the triangular insert draw to a common point. The testicles are left with a freakishly small amount of room. Besides the abrasive and traumatic factors in these misshapened and tight triangular designs, they do not allow true circulation of air, thus being unhealthy and hot. The subject invention provides a superior three-dimensional approach for the solution of these problems.

In U.S. Pat. No. 4,215,685 to Ibel a triangular cutout material piece is disclosed. A triangular-shaped insert has been shown repeatedly to be completely inadequate for the space needed for a volume to accommodate the male genitalia. As the triangular shape closes down two sides to a point, the volume drastically diminishes and proves itself unable to accommodate the male requirements for a crotch piece. The triangular shape simply presses back the male genitalia uncomfortably against the perineal area. This type of pouch design is not a true "bag-pouch".

In U.S. Pat. No. 5,539,926 to Mantos again a triangular flap is shown as a modified gusset. Again this is not a true pouch. The triangular piece compresses the testicles and traps the penis in a tight, limited and needlessly uncomfortable position.

In U.S. Pat. No. 4,035,844 to Atact et al. a specialized "trouser-like undergarment" is described and the design is not for outerwear. This design depends on the use of a rigid crotch cup, and does not intend in its design to produce, or concern itself with, the formation of a fitted or formed cloth crotch design for specific outer anatomical solutions.

In U.S. Pat. No. 4,587,675 to Prouty a triangular piece is shown again that is even more confining than the Mantos design because the front straps criss-cross behind the genitals, which positioning would be even more confining to the genitals, especially the backside of the scrotum. The genitals using this trouser design are literally trapped into a decreasing volume that is impractical and painful.

In U.S. Pat. No. 4,989,272 to Wagner a triangular design is disclosed which squeezes the testicles into a constricted center and trapping the penis in a tight, small and single location. These pants force the genitalia into an "upfront" position instead of a natural and relaxed hanging or "down" position.

In U.S. Pat. No. (2,306,514) to Wilken et al. a pajamas design is shown with a simple flat gusset which does not provide a cupped support. U.S. Pat. No. 2,702,545 to Orr discloses a simple saddle seam or modified gusset in the front of men's pants. There is no pouch or "bagged" effect of a true pouch described in this patent.

In U.S. Pat. No. 4,392,259 to Bredo a triangular shape is shown which may be used for both men and women. The insert is a design to protect the undergarment's seams from strain. The attention to physical conforms is very general and not directed to specific problems of a male-only anatomy.

None of the above mentioned patents provide the unique features and advantages of the subject three-dimensional one-piece male pants pouch as described herein.

SUMMARY OF THE INVENTION

In view of the foregoing, it is a primary object of the present invention to provide a three-dimensional male pants pouch for greater comfort when wearing pants having the pouch incorporated therein. The subject pants pouch is a "true" pants pouch design when compared to a flat two-dimensional gusset insert. The pants pouch in effect provides for a "bag" type pants architecture. Further, by the nature of the pants pouch three-dimensional design a hard cup insert which is often used in active men's wear is not required.

Another object of the invention is the pouch may be used with a variety of different pants designs used during normal day-to-day routines and during various types of physical activities with extra space for the genitals to easily shift and move within the pouch. Further, the three-dimensional space within the pouch allows for movement of air past the male genitals thus supporting proper temperature therein.

Still another object of the male pants pouch is the elimination of tightness against the male genitals allowing freedom of movement and removing the need for either right or left dress in fitted pants. Also the new pouch prevents a tethering of the genitals by a crotch seam common in men's pants.

Yet another object of the pants pouch is that it is perfectly fitted for use in outerwear pants, trousers such as jeans, work pants, dress slacks, suit pants and athletic pants wear of different kinds. This one-piece pouch design allows easy and fast pants production with superior construction for longer wear.

Another object of the invention is a circular bottom portion of the pants pouch engages ends of the pants two leg seams and an end of a back seam for reducing wear stress in a crotch area of the pants which heretofore had to be reinforced by additional stitching to prevent premature ripping of the pants.

The three-dimensional one-piece male pants pouch includes a fabric insert sewn into the front of the pants. The pouch fabric can match the fabric of the pants. The fabric insert includes a front and back, a top portion disposed along the belt line of the pants, a first side portion with access for opening and closing the front of the pants, a second side portion and a circular bottom portion. The width of the insert between the first and second side portions is sufficient to cover to male genital area of the wearer of the pants. The bottom portion of the insert is characterized by having darting therein. The darting provides the three-dimensional effect of the pouch for comfortably housing different size male genitals. The bottom portion also engages an end of the pants two leg seams and an end of a back seam for absorbing wear stress in the crotch of the pants which heretofore was absorbed by additional stitching at an intersection of the three seams.

These and other objects of the present invention will become apparent to those familiar with men's pants and trouser construction, the sewing of men's outerwear and other applications of men's wearing apparel when reviewing the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
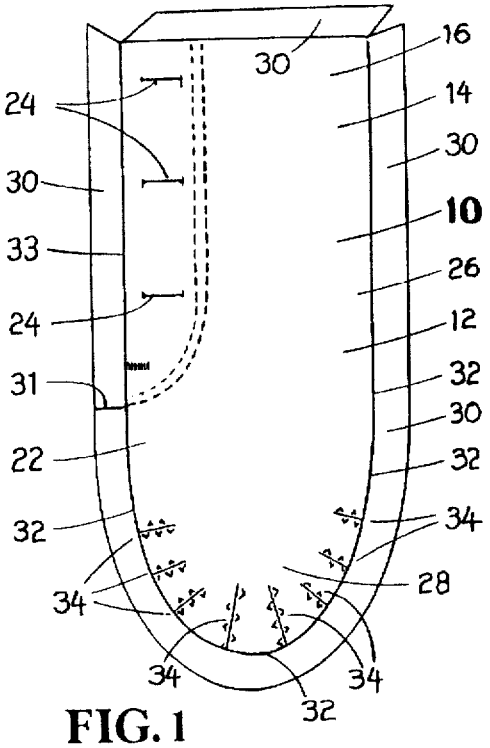
FIG. 1 is a front view of the subject three-dimensional one-piece male pants pouch.

In FIG. 1, the unique three-dimensional one-piece male pants pouch is shown having a general reference numeral 10. The pants pouch 10 includes a fabric insert 12 having a front 14, a back which is not shown in the drawings, a top portion 16 disposed along a belt line 18 of a pair of men's pants 20. The belt line 18 and pants 20 are shown in FIGS. 2–5. The fabric of the insert 12 may and normally would match the fabric of the pants 20. The insert 12 further includes a first side portion 22 with button holes 24 for providing access for opening and closing the pouch 10 when going to the bathroom or for putting on or taking off the pants 20. The insert 12 also includes a second side portion 26 and a circular bottom portion 28. The fabric insert 12 has a folded edge 30 with sew line 32 therearound which is used for stitching the insert 12 to the front of the pants 20. In the first side portion 22, a cut 31 is provided so that the folded edge 30 can be folded along a fold line 33 adjacent the button holes 24 and sewn.

A width of the insert 12 between the first and second side portions 22 and 26 is sufficient to cover to the male genital area of the wearer of the pants 20 and will vary with different size pants. The width typically would range from 4 to 8 inches or greater for larger men. The length of the insert from the top of the belt line 18 to a bottom of the bottom portion typically would range from 6 to 18 inches depending on the style and size of the pants 20. The circular bottom portion 28 of the insert 12 is characterized by having a plurality of darting 34 angled inwardly from the sew line 32 and disposed around part of the circular bottom portion 28. The darting 34 in FIG. 1 is shown intending inwardly at a right angle to the sew line 32. The darting 34 can be disposed at a right angle or various angles from the sew line without departing from the scope and spirit of the invention. The darting 34 converts the two-dimensional plane of the insert 12 into a three-dimensional one-piece pouch 10. The darting 34 is accomplished by cutting the fabric insert 12 or pleating or folding the fabric material together and then on the back side of the insert 12 the darting 34 is gathered and sewn. As mentioned above, this original design of the pouch 10 provides for the comfortable housing of different size male genitals.

Figure 2:
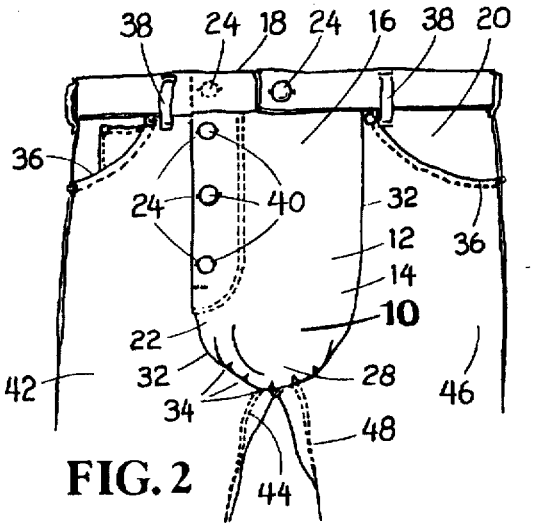
FIG. 2 is a front view of the one-piece male pants pouch incorporated into a pair of men's pants.

In FIG. 2 a front view of the one-piece male pants pouch 10 is shown incorporated into the men's pants 20. In this view the pants 20 is shown with front pockets 36, belt loops 38, buttons 40 for engaging the button holes 24, a first pants leg 42 with first pants leg seam 44 and a second pants leg 46 with a second pants leg seam 48. While the buttons 40 and button holes 24 in the insert 12 are shown in the drawings, a zipper, hook and loop fasteners and other types of securing means can be used equally well for opening and closing the subject male pants pouch 10. Along the belt line 18 is an added button 24 for securing the pants 20 in a closed position. Shown in dotted lines is another button 24 disposed above the buttons 24 for providing a different styling along the top of the pants 20. The top portion 16 of the insert 12 may extend up to the bottom of the belt line 18 or to the top of the belt line 18 as shown in dotted lines.

Figure 3:
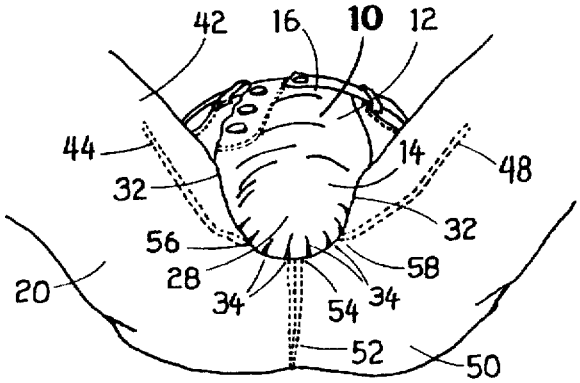
FIG. 3 is a perspective view of the pants seat and pants legs with a bottom portion of the pants pouch engaging two pants leg seams and a back seam in the pants seat.

FIG. 3 is a perspective view of a pants seat 50 with back seam 52. Heretofore, in the crotch area of a pair of pants, an end 54 of the back seam would intersect an end 56 of the first pants leg seam 44 and an end 58 of the second pants leg seam 48. In the subject invention, the, the bottom portion 28 of the insert 12 engages the end 56 of a first leg seam 44 of a first pants leg 42 and the end 58 of the second leg seam 48 of the second pants leg 46. The bottom portion also engages the end 54 of the back seam 52 of the pants seat 50. This important feature allows for absorbing wear stress in the crotch of the pants 20 to prevent the tearing or ripping of the pants 20 during wear. Also this feature eliminates the need for reinforcing the intersection of the three seams which often caused a large knot at the bottom of the crotch of the pants.

Figure 4:
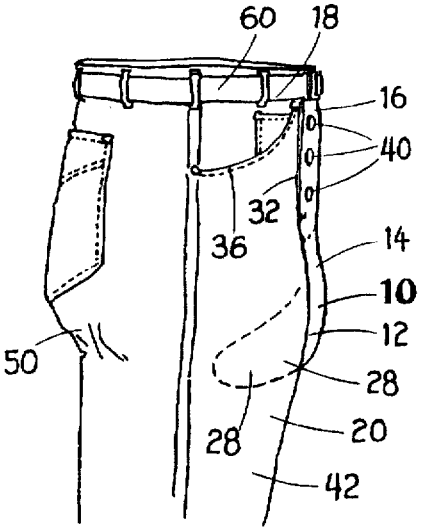
FIG. 4 is a side view of the men's pants and the pants pouch.

In FIG. 4 a side view of the men's pants 20 with the three-dimensional one-piece male pants pouch 10. The pants 20 in this figure are shown with a belt 60. Please note in this view, the outwardly extending pouch 10 with the darted circular bottom portion 28 providing a comfortable receiving area for the male genitals of the user of the pants 20.

Figure 5:
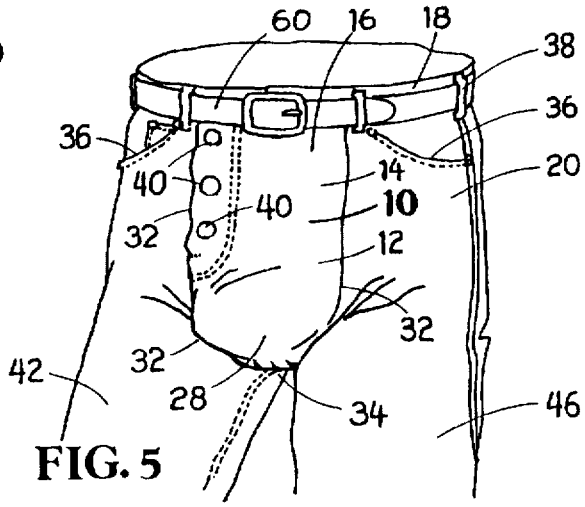
FIG. 5 is a front perspective view of the one-piece male pants pouch and the men's pants.

In FIG. 5 is a front perspective view of the one-piece male pants pouch 10 and the men's pants 20 are shown. In this perspective view, the insert 12 is shown incorporated into the front of the pants 20 and providing a pleasing, non-offensive pants styling which provides for greater comfort and better health for men using the new male pants pouch 10 incorporated into various types of men's pants, trousers, jeans and the like.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A three-dimensional one-piece male pants pouch for men's pants, the pants pouch is incorporated into the pants having a pants front, a belt line, a pants crotch, a first pants leg with a first pants leg seam, a second pants leg with second pants seam, a pants seat with back seam, the pants pouch comprising:

a fabric insert sewn into the front of the pants, the fabric insert having a front and a back, a top portion disposed along the belt line of the pants, a first side portion, a second side portion and bottom portion; and a plurality of darting disposed around part of the bottom portion of said fabric insert, said darting gathering the bottom portion of said fabric insert and creating a three-dimensional pouch therein.

2. The pants pouch as described in claim 1 wherein the bottom portion of said fabric insert engages the first and the second pants seams and the back seam of the pants seat in the crotch area of the pants.

3. The pants pouch as described in claim 1 wherein a width of said insert between the first and second side portions is sufficient to cover a male genital area of the wearer of the pants.

4. The pants pouch as described in claim 1 further including access means for opening and closing the front of the pouch and incorporated into the first side portion of said fabric insert.

5. A three-dimensional one-piece male pants pouch for men's pants, the pants pouch is incorporated into the pants having a pants front, a belt line, a pants crotch, a first pants leg with a first pants leg seam, a second pants leg with second pants seam, a pants seat with back seam, the pants pouch comprising:

a fabric insert sewn into the front of the pants, the fabric insert having a front and a back, a top portion disposed along the belt line of the pants, a first side portion having access means for opening and closing the front of the pouch, a second side portion and a circular bottom portion; and a plurality of darting disposed along a sew line around the circular bottom portion of said fabric insert and extending inwardly from the sew line at an angle to the sew line, said darting gathering a portion of the circular bottom portion of said fabric insert and creating a three-dimensional pouch therein.

6. The pants pouch as described in claim 5 wherein the darting extends inwardly from the sew line at right angles.

7. The pants pouch as described in claim 5 wherein the bottom portion of said fabric insert engages the first and the second pants seams and the back seam of the pants seat in the crotch area of the pants whereby eliminating an intersection of ends of the first and second pants seams and an end of the back seam.

8. The pants pouch as described in claim 5 wherein a width of said insert between the first and second side portions is sufficient to cover a male genital area of the wearer of the pants and a length of said insert from the top portion to the circular bottom portion is sufficient to cover the male genital area.

9. The pants pouch as described in claim 5 wherein said access means is a plurality of button holes disposed in the first side portion of said fabric insert for engaging buttons sewn on the front of the pants.

10. The pants pouch as described in claim 5 wherein said access means is a zipper attached to the first side portion of said fabric insert and attached to a portion of the front of the pants.

11. A three-dimensional one-piece male pants pouch for men's pants, the pants pouch is incorporated into the pants having a pants front, a belt line, a pants crotch, a first pants leg with a first pants leg seam, a second pants leg with second pants seam, a pants seat with back seam, the pants pouch comprising:

a fabric insert sewn into the front of the pants, the fabric insert having a front and a back, a top portion disposed along a portion of the belt line of the pants, a first side portion with access means for opening and closing the front of the pants pouch, a second side portion and a circular bottom portion; and a plurality of darting disposed along a sew line around the circular bottom portion of said fabric insert and extending inwardly from the sew line at an angle to the sew line.

12. The pants pouch as described in claim 11 wherein the bottom portion of said fabric insert includes a folded edge along the sew line for engaging and securing the first and the second pants seams and the back seam of the pants seat in the crotch area of the pants for reducing wear stress in the crotch area.

13. The pants pouch as described in claim 11 a wherein a width of said insert between the first and second side portions is sufficient to cover a male genital area of the wearer of the pants, the width in a range of 4 to 8 inches.

14. The pants pouch as described in claim 11 wherein a length of said insert from the top portion to the bottom portion is sufficient to cover a male genital area of the wearer of the pants, the length in a range of 6 to 18 inches.

* * * * *